United States Patent [19]

Shelnutt

[11] Patent Number: 5,026,052

[45] Date of Patent: Jun. 25, 1991

[54] GAME AND CRUCIFORM GAME TABLE

[75] Inventor: Robert C. Shelnutt, Palm Harbor, Fla.

[73] Assignee: American Fun & Games, Inc., Palm Harbor, Fla.

[21] Appl. No.: 566,007

[22] Filed: Aug. 9, 1990

[51] Int. Cl.[5] ..... A63D 15/00

[52] U.S. Cl. ..... 273/3 A

[58] Field of Search ..... 273/3 A, 2, 3 R

[56] References Cited

U.S. PATENT DOCUMENTS 2,462,526 2/1949 McNair ..... 273/3 R 4,431,186 2/1984 Gold ..... 273/3 A

*Primary Examiner*—Theatrice Brown

*Attorney, Agent, or Firm*—Joseph C. Mason, Jr.; Ronald E. Smith

[57] ABSTRACT

A game t able having a cruciform shape when seen in plan view. A generally circular "in play" area is bounded by four generally rectangular and contiguous base areas. The table top is flat and the "in play" area and the surrounding base areas are demarcated only by a generally circular line of demarcation. Four ball-receiving pockets are equidistantly and circumferentially spaced about the periphery of the circular "in play" area, and points are scored by holing balls in those pockets. No ball can be holed unless it is in the "in play" area. However, each player may take a positioning shot to knock a ball into the "in play" area prior to taking a scoring shot. There are two different sets of balls and in some games, all members of one set must be holed before any members of the second set. A cue ball and a bogey ball are also involved in play, and detailed rules govern the several games.

11 Claims, 4 Drawing Sheets

GAME AND CRUCIFORM GAME TABLE

TECHNICAL FIELD

This invention relates, generally, to billiard-like games and apparatus for playing such games. More particularly, it relates to a game apparatus including a game table of cruciform configuration when seen in plan view.

BACKGROUND ART

The well-known game of billiards is played on a game table having a rectangular playing surface with rebound rails positioned about the periphery thereof; ball-receiving receptacles or pockets are disposed at the four enclosing corners of the game surface and mid-length of the elongate side rails.

Although this simple arrangement of parts and the game played with such parts has met with great commercial success over the years, inventors have undertaken to improve upon the game and game apparatus and have created numerous new games and new playing devices, all of which are intended to increase the pleasure derived from the games by both players and spectators.

For example, U.S. Pat. No. 4,844,457 to Webster shows an "L"-shaped playing surface, U.S. Pat. No. 4,294,449 to Shaw shows a diamond-shaped playing surface, U.S. Pat. No. 4,834,384 to Cortesi shows a long table having an enlarged or bulbous end, and so on.

Cruciform shapes appear in U.S. Pat. Nos. 3,985,355 to Shoemaker, 2,462,526 to McNair and 1,502,607 to Wright.

Despite the new shapes and game rules that have been created in an effort to make billiards-type games more stimulating, the new games have retained many important characteristics of the original game. Specifically, the new games still require the player to hit a ball into a pocket by using a cue ball and a cue stick. If the player misses the shot, play moves to another player. If the player is presented with a substantially unmakable shot, he or she has no recourse but to attempt the shot anyway. This drawback to the enjoyment of the various games has hindered development of billiard-type games, but the prior art, considered as a whole, neither teaches nor suggests how the shortcomings of the art might be overcome.

DISCLOSURE OF INVENTION

The longstanding but heretofore unfulfilled need for a billiards-type game that gives each player a chance to set up a scoring shot is now provided in the form of a novel game that incorporates a game table of heretofore unknown design.

The novel game table has a plus sign (+) or cruciform appearance when seen in plan view. Thus, the playing surface includes four generally rectangular areas that surround and extend radially from a circular center region. More specifically, eight enclosing corners are circumferentially and equidistantly spaced apart from one another and are coincident with a first circle having a predetermined diameter. Four diverging corners are positioned radially inwardly therefrom, also at circumferentially and equidistantly spaced intervals from one another, and said four diverging corners are coincident with a second circle having a predetermined diameter less than that of the first circle.

Four ball-receiving receptacles or pockets are positioned at each diverging corner. A generally circular "in-play" field is defined just radially inwardly of said pockets but each pocket is included in the "in play" area.

Each player is entitled to two shots per turn if the first shot is successfully executed. More particularly, the first shot is a set-up or positioning shot, also called a centering shot, which merely paves the way for the second or scoring shot. In this manner, a player who begins his or her turn with an unlucky arrangement of balls on the table has the opportunity to make a first shot, that need not result in a score, that sets up a subsequent attempt for a scoring shot. If the scoring shot is made, another positioning shot is awarded, and so on. Numerous details of play will be set forth in the detailed description that follows.

Thus it is seen that an important object of this invention is to provide a game table having a unique shape that provides an interesting and heretofore unknown challenge for skilled billiards players.

Another major object is to provide new games wherein each player has an opportunity to make, in effect, two shots per turn where the first shot need not be a scoring shot.

These and other objects, features and advantages of the invention will become more apparent as this description proceeds.

This invention is clearly new and useful. Moreover, it was not obvious to those of ordinary skill in the art at the time it was made, in view of the prior art, taken as a whole.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several view of the drawings.

BEST MODES FOR CARRYING OUT THE INVENTION

Figure 1:
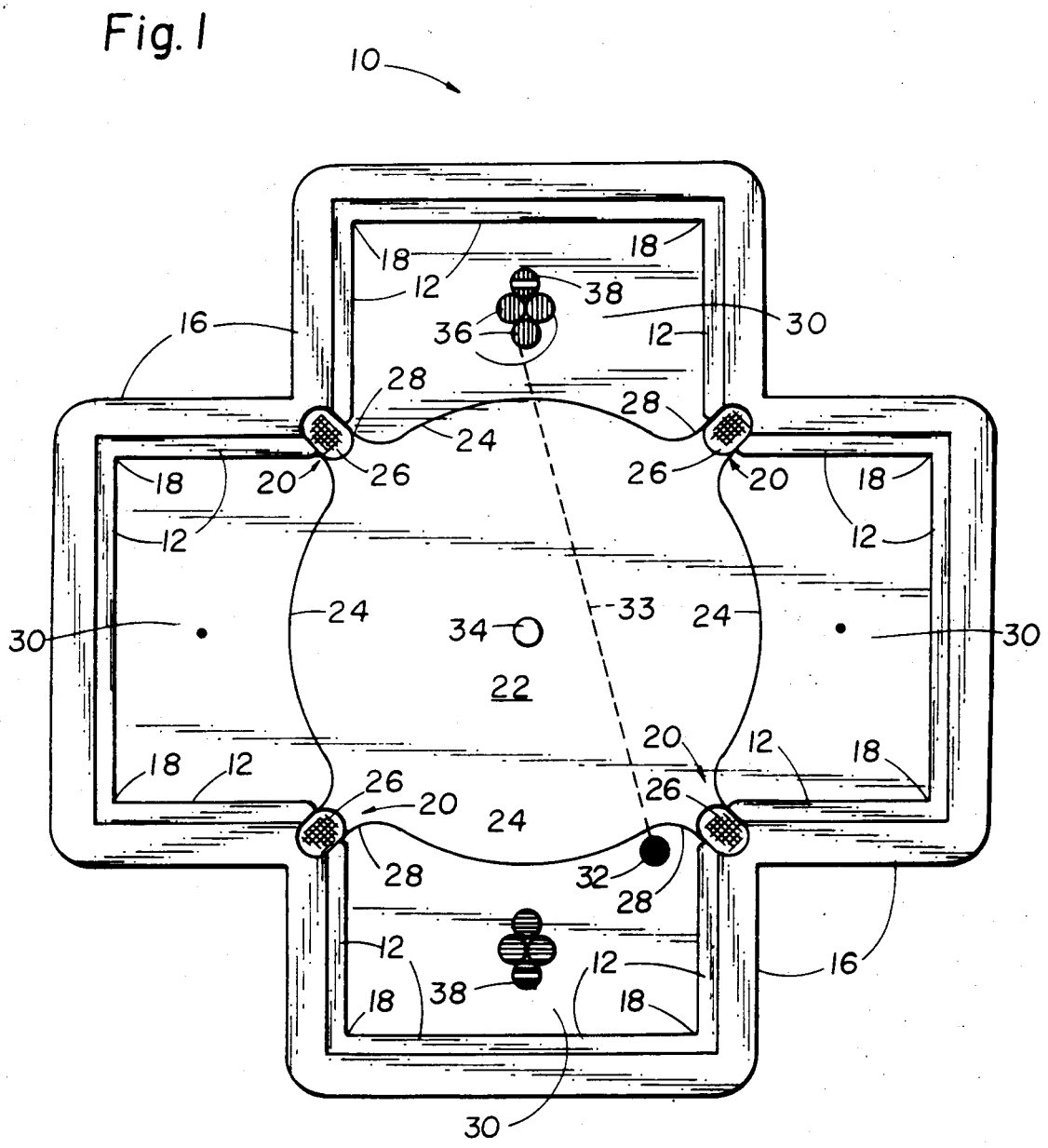
FIG. 1 is a plan view of an exemplary embodiment of the invention showing the balls in their racked configuration when only two players are playing a game.

Referring now to FIG. 1, it will there be seen that the novel game apparatus table is denoted by the reference numeral 10 as a whole.

Table 10 has the symmetrical cruciform configuration depicted. Standard snooker ball rebound rails, collectively denoted 12, define the outer perimeter of the playing surface; such rails are spaced radially inwardly from the outermost periphery 16 of the table as shown. Rails 12 thus define eight enclosing corners, collectively denoted 18, and four diverging corners, collectively denoted 20. It should be noted that a first imaginary circle interconnects the enclosing corners 18 and a second imaginary circle of smaller diameter interconnects the diverging corners 20. Since the table is symmetrical in design, the corners are equidistantly spaced at circumferential intervals along the perimeter of the respective circles.

A central area 22 is bounded by a generally circular boundary line 24; the circumscribed area 22 is the "in play" area. It should be noted that ball-receiving pockets, collectively denoted 26, are positioned at each diverging corner 20 and are included in the in play area circle due to the radially outwardly extending sections 28 thereof.

Two to four players may play the first novel game disclosed herein; it is called Cut Throat or Showdown (trademark); the FIGS. depict a two player game. Each player is assigned a base area, collectively denoted 30. Each base area 30 is separated from the in play area 22 by boundary line 24, which is called the rib line due to its configuration at each base area 30. Balls in the respective base areas are not in play. Line 24 is a line of demarcation only and presents no obstacle to balls rolling thereover, i.e., the table top is flat and the in play and base areas are co-planar.

Player number one begins play by breaking the rack with a ball known as a bogey ball; the bogey is denoted 32 in the drawings, and is positioned in the lower right hand corner of FIG. 1. It is a neutral ball that is used by both players in their turn. The breaking player places the bogey ball at any preselected position behind his or her rib line 24 and impacts said ball with the cue stick in the usual way, as denoted by dotted line 33 in FIG. 1. The object of this beginning shot is to break the opponent's rack and to get as many of the opponent's balls as possible into the in play area 22. The bogey ball 32 remains wherever it lands for the opponent to play when it is the opponent's turn. The bogey ball 32 is also used for positioning shots as described hereinafter. Note that cueball 34 is placed in the center of table 10 to begin play.

Figure 2:
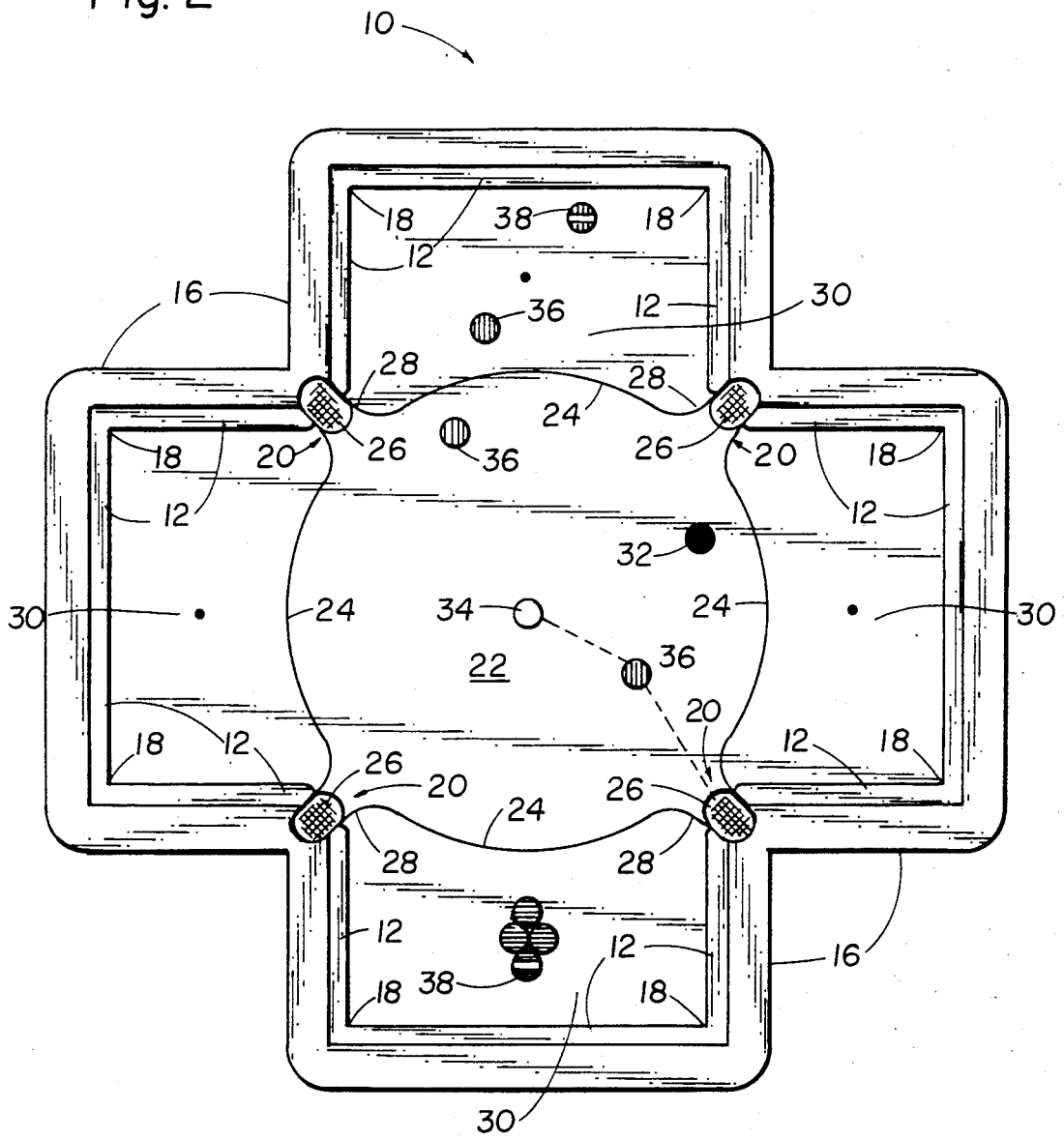
FIG. 2 is a plan view showing an illustrative array of balls after a rack has been broken and showing a scoring shot in dotted lines.

FIG. 2 shows a typical break after bogey ball 32 has been used by the first player. That player may now attempt to score by sinking one of the opponent's balls 36 (red) into any pocket 26 which seems optimal. Cueball 34 must be used in all score attempts. If the player succeeds with this shot, as shown by the dotted lines, he or she may either line up another shot with the bogey ball 32, or with his or her own striped ball 38, once it has been broken from the rack, or make a scoring shot with the cue ball 34 if that is more advantageous with four players. The rack directly across form the player in turn must be broken before that player is eligible for any scoring shots. With three players, player #1 has the responsibility of breaking the rack of player #3, player #2 has the responsibility of breaking rack #1 and player #3 must break the rack of player #2. Each time an opponent's ball is holed, the player has the above options. When a positioning or scoring shot is missed, play moves to the opponent, who must first break the first player's rack, and play then proceeds in the manner that has been disclosed. Each time a player fails to position an opponents' ball 36 in play or fails to hole an opponent's ball after making such a centering shot, play moves to the opponent. The opponent's striped ball 38 must be the last ball holed, and the player must call which pocket is aimed for. Play ends when one players has holed all of the opponent's balls.

Figure 3:
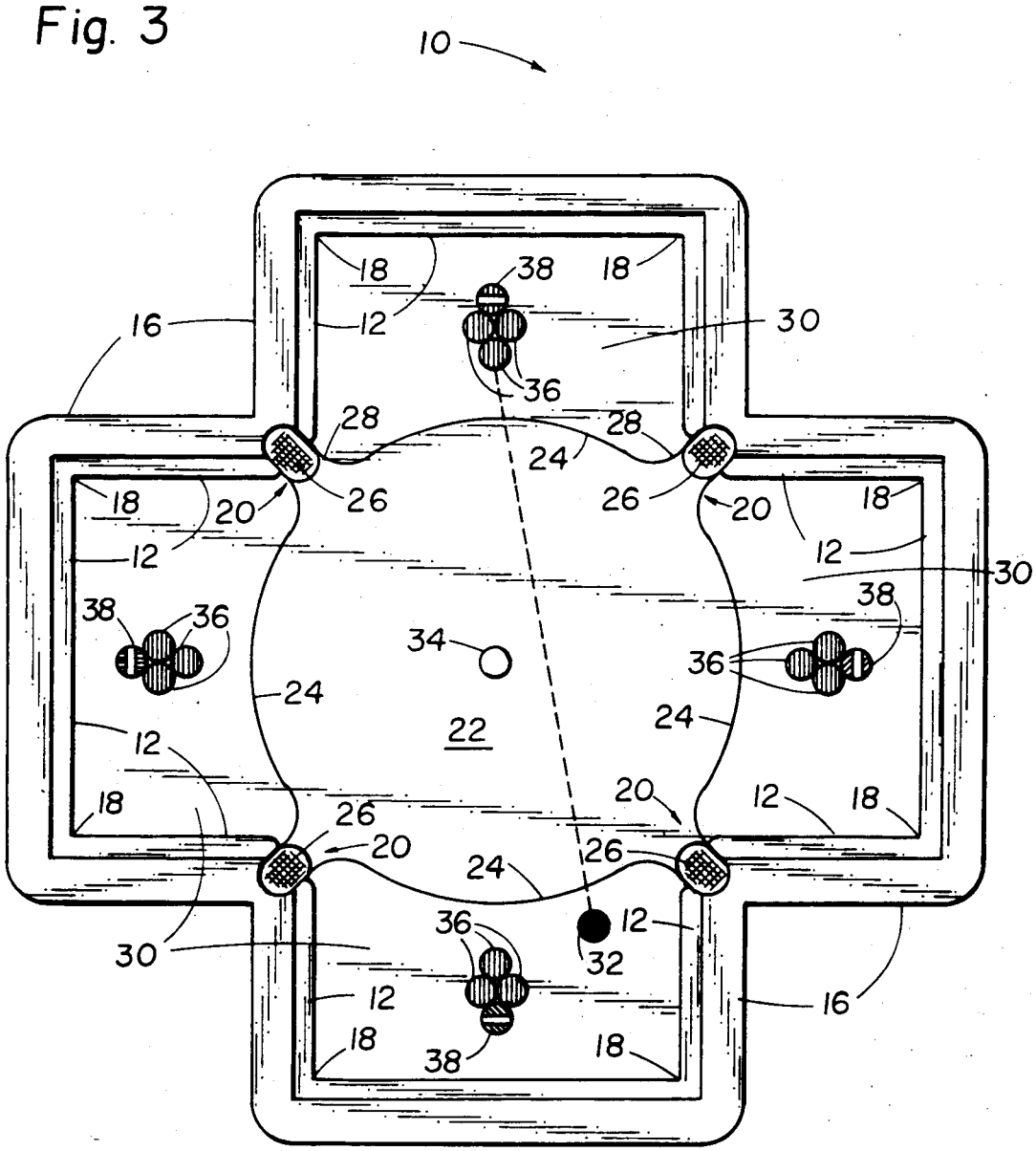
FIG. 3 is a view like FIG. 1, but showing the initial set up of a game played with four players.
Figure 4:
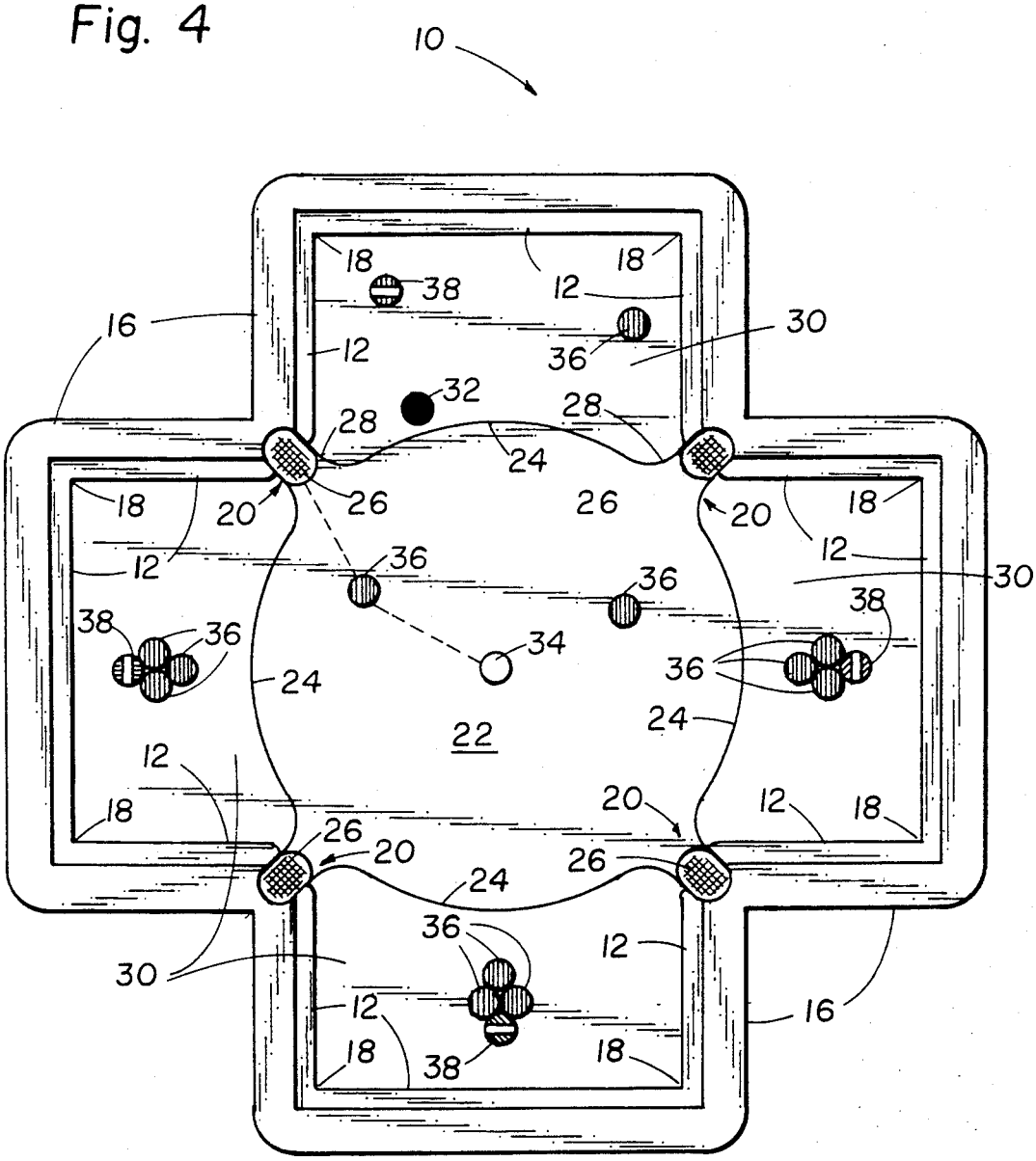
FIG. 4 is a view similar to FIG. 2.

In a second exemplary game (called 30 points), shown in FIGS. 3 and 4, four numbered balls are placed in a ball caddy and the four players blindly draw therefrom to establish the order of play, i.e., the player who draws ball number one goes first. The number drawn also determines the players's position around the table, i.e., each base area 30 is numbered 1–4 and each player is assigned the base area that corresponds to the number drawn.

There are two different types of balls in each player's rack. Three of the balls are red in color or otherwise suitably tinted and are called "pawns"; in a generic sense, they may be thought of as object balls. Holing a pawn in a pocket 26 earns three points for the player making the shot, but a called bank shot raises the point value of a pawn to six points.

The remaining ball in each rack is solid in color and numbered to distinguish it from the unnumbered object balls; these numbered balls are called "prime" balls and are collectively denoted 38. They may be used for positioning shots. Upon his turn, the player decides whether his prime ball or the bogey ball is most advantageously employed for positioning object balls in play.

After the break, shown in dotted lines in FIG. 3, the breaking player may score three points by holing a pawn ball that is in play with a shot using the cue ball (or six points if a called bank shot is made); the bogey ball may not be used for such a scoring shot. However, if the lay of the balls is such that no pawn balls are in play or those in play are positioned such that a scoring shot is deemed unmakable, the player may first execute a positioning shot. The cue ball may not be used for the positioning shot. However, the player may use either the bogey ball 32 or his prime ball 38 in an effort to set up a scoring shot. If the positioning shot is successful, i.e., if it knocks a pawn ball into play (i.e., into area 22), or better positions a pawn ball that was already in area 22, or better positions the cue ball in an attempt to put it in a better scoring position, the player may then attempt a second shot as depicted in FIG. 4. Only the cue ball 34 may be used for the scoring shot and it must be played where it lies, i.e., it may not be taken in hand. Moreover, as long as there are pawn balls 36 on the table, only pawn balls may be holed out. A successful shot enables the player to execute another scoring shot or another positioning (or centering) shot and so on. Play does not move to the second player until the first player has no eligible balls in play after a positioning shot, or misses a scoring shot.

Once all pawns 36 have been holed, the players then begin holing the prime balls 38; play is just the same as with the pawn part of the game, except that a player may hole out a prime ball of an opponent and thereby eliminate that player from the rack being played, i.e., a player having a prime ball holed out by an opponent cannot re-enter the game until the next rack is broken. A holed prime ball scores 6 points unless it is a called bank shot which doubles the point value to 12.

The location of the bogey ball 32 becomes important as the game nears its end because if the bogey ball 32 is positioned in a player's base area 30 when the last pawn ball 36 is holed, a nine point penalty is assessed against the player, hence the name of the ball.

After the penalty assessment, the bogey ball 32 is restored to its neutral function as a positioning ball and it is no longer detrimental to a player to have said ball in his or her base area 30.

If the bogey ball 32 is holed at any time during play, it is taken "in hand" by the next player and spotted anywhere behind that player's rib line 24. Any other ineligible ball that is holed is spotted in accordance with the scratch rules set forth hereinafter.

As in conventional billiards-like games, a scratch is declared if a scoring shot also holes the cue ball 34; the points are disallowed and the cue ball passes to the next player in the rotation, with the cue ball being spotted at table center. Play then continues as before. If a prime ball 38 is holed in a scratch shot, it is spotted on its base spot, whereas a pawn 36 is spotted at the center of the in play area. Knocking a ball off the table is also considered a scratch. Any scratch ends a player's turn. Any object ball holed during a positioning shot also ends that player's turn.

Play ends when a player is the first to score 30 points; that player is the winner of the game. If the entire rack is played with no players scoring thirty points (the end of a rack occurs when a single prime ball 38 remains on the table), along with the cue ball and bogey, said remaining prime ball, the cue ball 34 and the bogey ball 32 are left in place on the table and the holed balls are re-racked. However, if the remaining prime, cue or bogey are within a player's rack area, said balls are spotted according to the scratch rules, i.e., the prime ball is placed on its base spot, the cue is placed at the center of the in play area, and the bogey ball is placed in hand behind the player's rib line 24.

Play resumes with the player who had the last remaining prime 38 on the game table; that player breaks the rack with the bogey 32 and play follows the normal rules as previously outlined until a player scores thirty points at which time the game is over. Players accumulate their respective score totals from one rack to another until there is a thirty point winner.

When playing a safe, the player must cause the stroked ball to hit one other ball and a rail, or two rails. If this is not done, the next player has the option of making that player shoot again, or may take his turn from where the balls come to rest.

In a two player game, the prime balls for positions two and four are replaced by pawn (red) balls. The break is determined as previously set forth with the exception that only the prime balls numbered one and three and the cue ball are placed in the ball caddy prior to the blind draw to determine player position and break. In a three player game, prime ball number four is replaced by a pawn (red) ball.

This invention pioneers the art of billiard-like games where each player is accorded at least two shots per turn, and it also pioneers the art of game tables having a cruciform configuration. "Y"-shaped, star-shaped, and other configurations where a central "in play" area is surrounded by radially outwardly extending base areas are all within the scope of this invention. Accordingly, the claims that follow are to be broadly interpreted to protect the heart or essence of this invention from piracy.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A game table, comprising:

a flat, cruciform-in-configuration playing surface;

a rail positioned about an outer periphery of said playing surface;

said rail defining eight enclosing corners, all of said enclosing corners being coincident with a first circle having a first predetermined diameter;

said rail defining four diverging corners, all of said diverging corners being coincident with a second circle having a second predetermined diameter;

said second predetermined diameter being less than said first predetermined diameter; and a ball-receiving receptacle positioned at each of said diverging corners.

2. The game table of claim 1, further comprising:

a generally circular line of demarcation disposed on said playing surface;

said line of demarcation being concentric with and generally coincident to said second circle.

3. The game table of claim 2, further comprising:

an in play area that is circumscribed by said line of demarcation;

a plurality of base areas disposed radially outwardly of said line of demarcation;

each base area of said plurality of base areas having a generally rectangular configuration; and said in play area and each of said plurality of base areas being co-planar.

4. The game table of claim 3, wherein said line of demarcation includes a plurality of four radially outwardly extending sections so that said receptacles are included in said in play area.

5. A method of playing a billiards-like game, comprising the steps of:

providing a game table having a playing surface of cruciform configuration in plan view;

positioning a pocket at each diverging corner of said playing surface;

defining an in play area by forming a generally circular line of demarcation on said playing surface in substantially interconnecting relation to said pockets;

disposing a plurality of game balls atop said playing surface;

scoring points by holing a preselected game ball that is positioned within said in play area;

executing a scoring shot by attempting to hole a preselected game ball if that game ball is within said in play area when said player's turn begins;

executing a positioning shot to place a preselected game ball in said in play area if no playable game ball was in said in play area, and, alternatively, to put additional balls in play, at the beginning of that player's turn; and following said positioning shot with an attempt to execute a scoring shot if said positioning shot successfully places a preselected game ball within said in play area.

6. The method of claim 5, further comprising the steps of:

providing a cue ball and a cue stick; and using said cue ball only to make a scoring shot.

7. The method of claim 6, further comprising the steps of:

providing a first plurality of balls having a common indicia;

providing a second plurality of balls having a common indicia;

placing said first and second plurality of balls in a rack at the beginning of a game;

breaking said rack; and holing all of said first plurality of balls before holing any of said second plurality of balls.

8. The method of claim 7, further comprising the steps of:

providing a bogey ball; and using said bogey ball to make a positioning shot.

9. The method of claim 8, further comprising the step of using a ball of said second plurality of balls to make a positioning shot, alternative to using said bogey ball to make said positioning shot.

10. The method of claim 9, further comprising the step of using said bogey ball to break said rack.

11. The method of claim 10, further comprising the step of positioning said bogey ball within a base area associated with the player breaking said rack prior to impacting said bogey ball with said cue stick.

* * * * *